US011381029B2

(12) United States Patent
McDonald et al.

(10) Patent No.: US 11,381,029 B2
(45) Date of Patent: Jul. 5, 2022

(54) EASY MOUNT LIGHTING FIXTURE AND ELECTRICAL RECEPTACLE SYSTEM

(71) Applicant: J&J Properties of Cortland, LLC, Cortland, OH (US)

(72) Inventors: John McDonald, Cortland, OH (US); Joseph Driscoll, Warren, OH (US)

( * ) Notice: Subject to any disclaimer, the term of this patent is extended or adjusted under 35 U.S.C. 154(b) by 0 days.

(21) Appl. No.: 17/179,732

(22) Filed: Feb. 19, 2021

(65) Prior Publication Data

US 2021/0281008 A1 Sep. 9, 2021

Related U.S. Application Data

(60) Provisional application No. 62/986,855, filed on Mar. 9, 2020.

(51) Int. Cl.
*H01R 13/26* (2006.01)
*H01R 13/52* (2006.01)

(52) U.S. Cl.
CPC ..... *H01R 13/5213* (2013.01); *H01R 13/26* (2013.01)

(58) Field of Classification Search
CPC .... H01R 13/447; H01R 31/06; H01R 25/006; H01R 13/6395; H01R 13/4534; H01R 13/4538; H01R 13/5213; H01R 13/6675
See application file for complete search history.

(56) References Cited

U.S. PATENT DOCUMENTS

| | | | | |
|---|---|---|---|---|
| 1,595,972 A | | 8/1926 | Reamer | |
| 1,614,163 A | | 1/1927 | Van Amberg | |
| 1,629,568 A | * | 5/1927 | Benjamin | F21V 21/02 439/529 |
| 3,928,716 A | * | 12/1975 | Marrero | H02G 3/125 174/57 |
| 4,640,564 A | * | 2/1987 | Hill | H01R 13/447 439/137 |
| 5,934,919 A | * | 8/1999 | Cross | H01R 13/6395 439/373 |
| 7,556,511 B1 | * | 7/2009 | Hsu | H01R 25/142 439/652 |
| 2021/0151968 A1 | * | 5/2021 | Oliver | H01R 13/447 |
| 2022/0037826 A1 | * | 2/2022 | Colvonen | H01R 13/443 |

* cited by examiner

*Primary Examiner* — Truc T Nguyen

(74) *Attorney, Agent, or Firm* — Harpman & Harpman

(57) ABSTRACT

An electrical and receptacle and fixture system that provides a simple, safe and quick mechanical electrical connection for mounting electrical fixtures to a receptacle box and connecting electrical equipment. The connection system has dedicated fixture and receptacle as well as conversion adapters for existing electrical connections.

5 Claims, 4 Drawing Sheets

EASY MOUNT LIGHTING FIXTURE AND ELECTRICAL RECEPTACLE SYSTEM

This application claims the benefit of U.S. Provisional Application No. 62/986,855, filed on Mar. 9, 2020.

BACKGROUND OF THE INVENTION

1. Technical Field

This invention relates to electrical fixtures such as lighting and electrical receptacles required to connect electrical power devices to a source of electricity in a residential or commercial application.

2. Description of Prior Art

Prior art devices of this type can be seen in adapted plug-in light fixtures, for example, see U.S. Pat. Nos. 1,614,163, 1,629,568 and 1,595,972.

Standard power outlet receptacles as having a plug-in configuration where a wall receptacle has multiple plug receiving apertures, each corresponding to a hot "positive" and correspondingly "negative" common side of an electrical circuit with an independent ground.

SUMMARY OF THE INVENTION

An electrical receptacle and mounting fixture system for electrical connections of fixed fixtures and receptacle plugs adapted for electrical equipment and the like. The connector system uses a power distribution connector block with opposing positive and neutral contact surfaces thereon. An integrated safety and support cover defines fixture and plug engagement release orientation for connective support with resilient use activation release lock in plug adapted configurations.

DETAILED DESCRIPTION OF THE INVENTION

Figure 1:
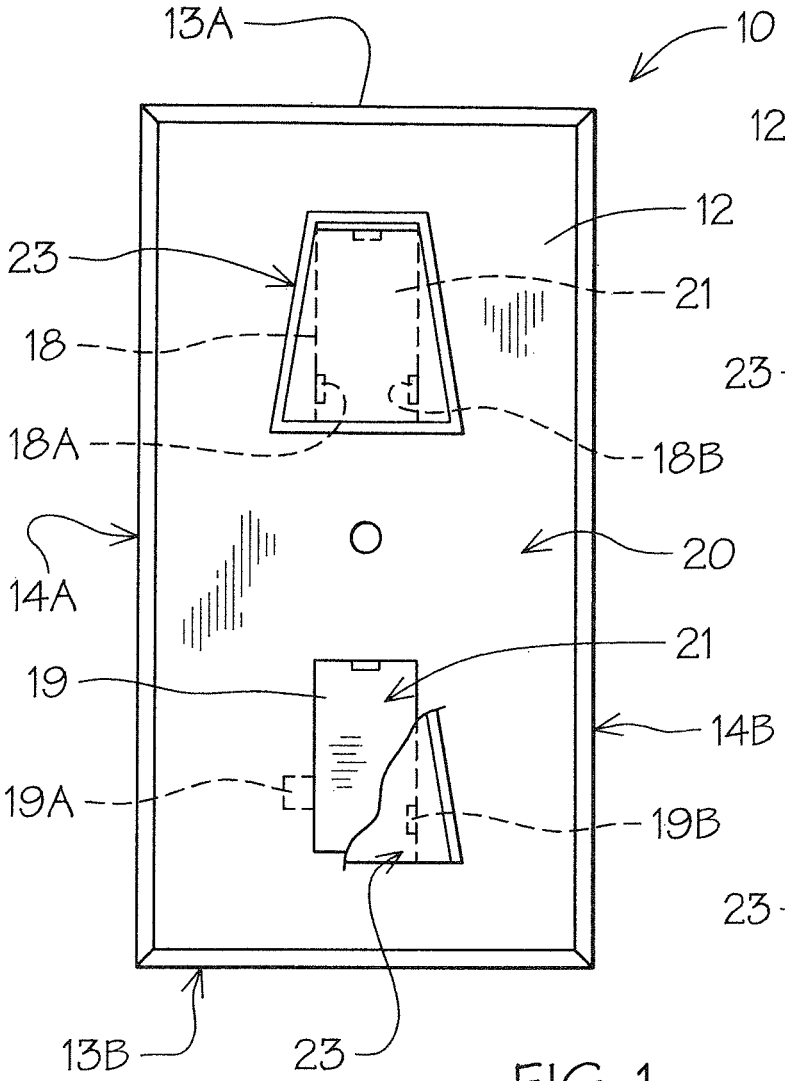
FIG. 1 is a front elevational view of the receptacle plug adapter of the invention.
Figure 2:
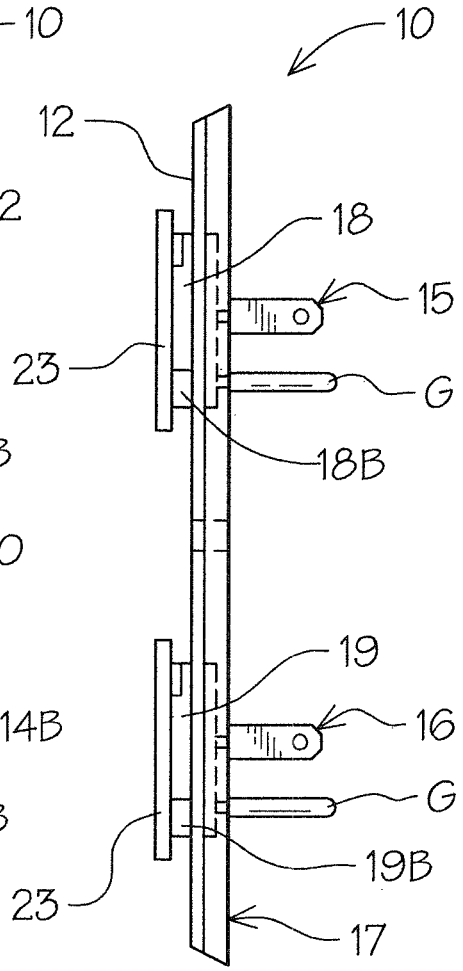
FIG. 2 is a side elevational view thereof.
Figure 3:
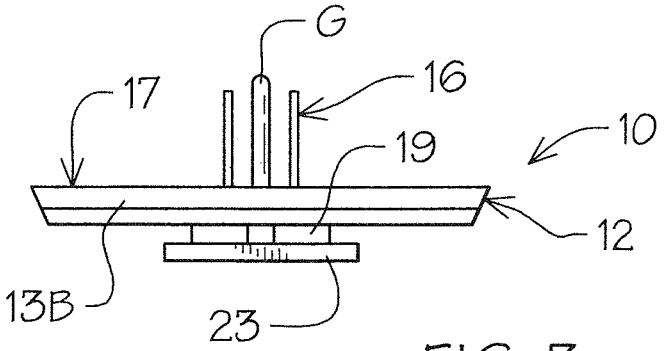
FIG. 3 is a bottom plan view thereof.

Referring to FIGS. 1-3 of the drawings, a primary electrical receptacle adapter fitting 10 can be seen having a main support body 12 with equilateral top surfaces 13A, bottom surfaces 13B and respective spaced parallel side surfaces 14A and 14B. In this example chosen for illustration, a pair of spaced standard electrical plugs 15 and 16 found in the majority of domestic electrical supply systems extend from a rear surface 17 of the body member 12. The plugs 15 and 16 are adaptable for engagement into a power wall receptacle, not shown, as is well understood and common within the art.

The standard electrical plugs 15 and 16 have a hot H and neutral N prongs and in this example a ground plug G.

Each of the electrical plugs 15 and 16 are in electrical communication with respective power transfer blocks 18 and 19 of the invention on the front surface 20 of the body member 12. Each of the power transfer blocks 18 and 19 are of a raised rectangular configuration having a flat front surface 21 with electrical conductive metal side surface strips 18A and 18B and 19A and 19B respectively which are preferably made of brass and are in direct electrical contact with their corresponding electrical plug assemblies 15 and 16.

Each of the respective raised power transfer blocks 18 and 19 have an overlapping cover 23 thereon which is of a foreshortened flat triangular configuration, best seen in FIG. 1 of the drawings.

Figure 4:
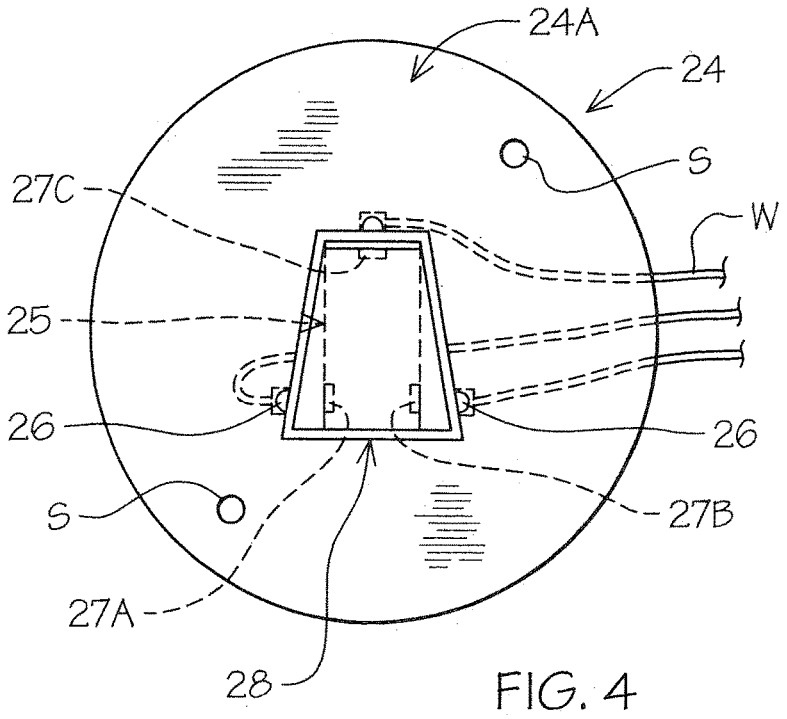
FIG. 4 is a front elevational view of a work box plate showing the fixture mounting and connection elements of the system.
Figure 5:
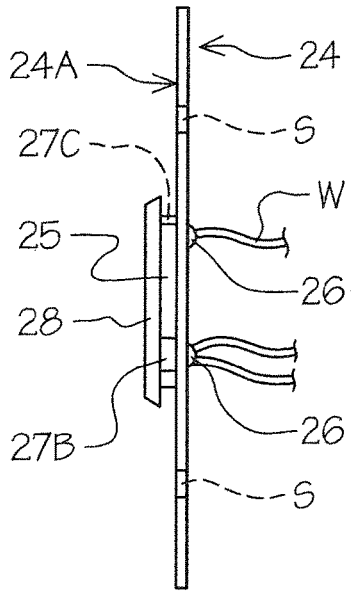
FIG. 5 is a side elevational view thereof.

Referring now to FIGS. 4 and 5 of the drawings, a surface electrical fixture mounting adapter plate 24 of the invention can be seen for use with an existing in the wall junction mounting box, not shown.

The fixture mounting adapter plate 24 has, in this example, a circular configuration but could be of any shape, such as square, not shown, which will match the appropriate mounting box so used.

The adapter plate 24 has a flat annular surface 24A with a pair of screw holes S for attaching to an existing wall box. A central raised upstanding power transfer block 25 is provided that extends from the front plate surface 24A and has a pair of electrical and attachment connectors 26 securing it to the plate and providing attachment screws for connecting to power wires in the mounting box, in this example, as will be well understood by those skilled in the art.

The power transfer block 25 is rectangular having a pair of power transfer strips 27A and 27B on respective spaced side surfaces thereof in communication with the afore referred to power connections 26. A ground wire connector 27C is positioned on the upper end surface of the power transfer block 25.

An overlapping safety and engagement support cover 28 identical to that described in the receptacle adapter fitting 10 is provided and is, as noted, of a foreshortened triangular shape.

Figure 6:
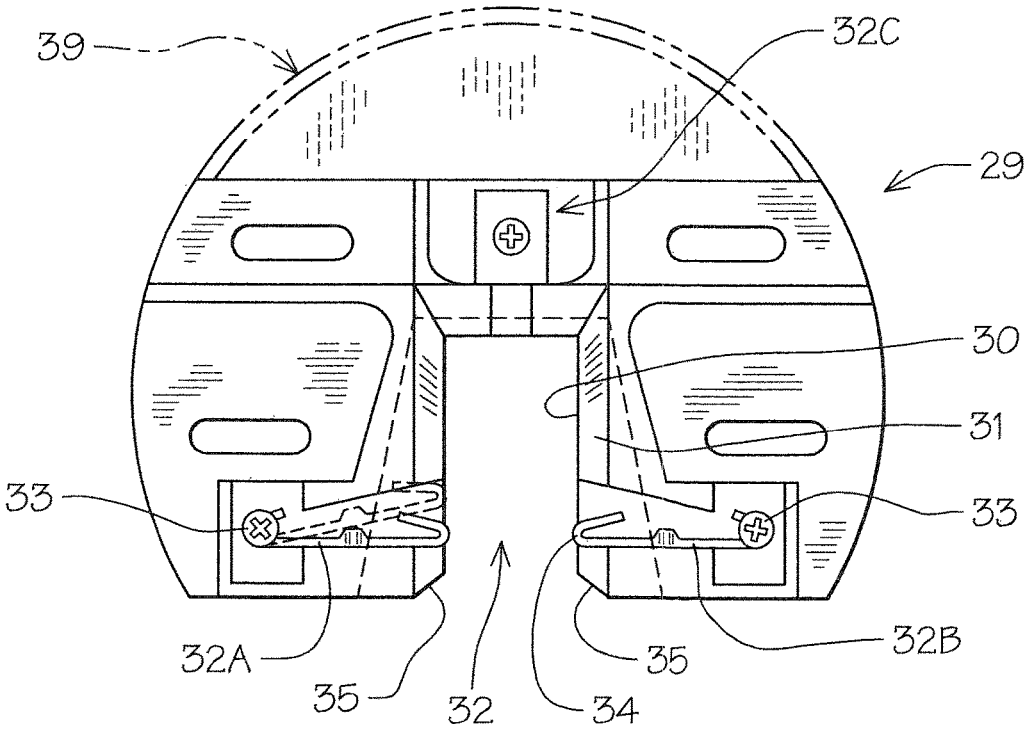
FIG. 6 is a partial rear elevational view of an electrical fixture example with interlocking mounting and release connector adapters of the system.

Referring now to FIG. 6 of the drawings, a universal fixture power connector and attachment support fitting 29 can be seen with a female fitting 30 that has a contoured recess 31 with an opening slot 32 and corresponding pair of resilient metal power contact wires 32A and 32B thereon, and a ground contact screw assembly 32C there between.

Figure 7:
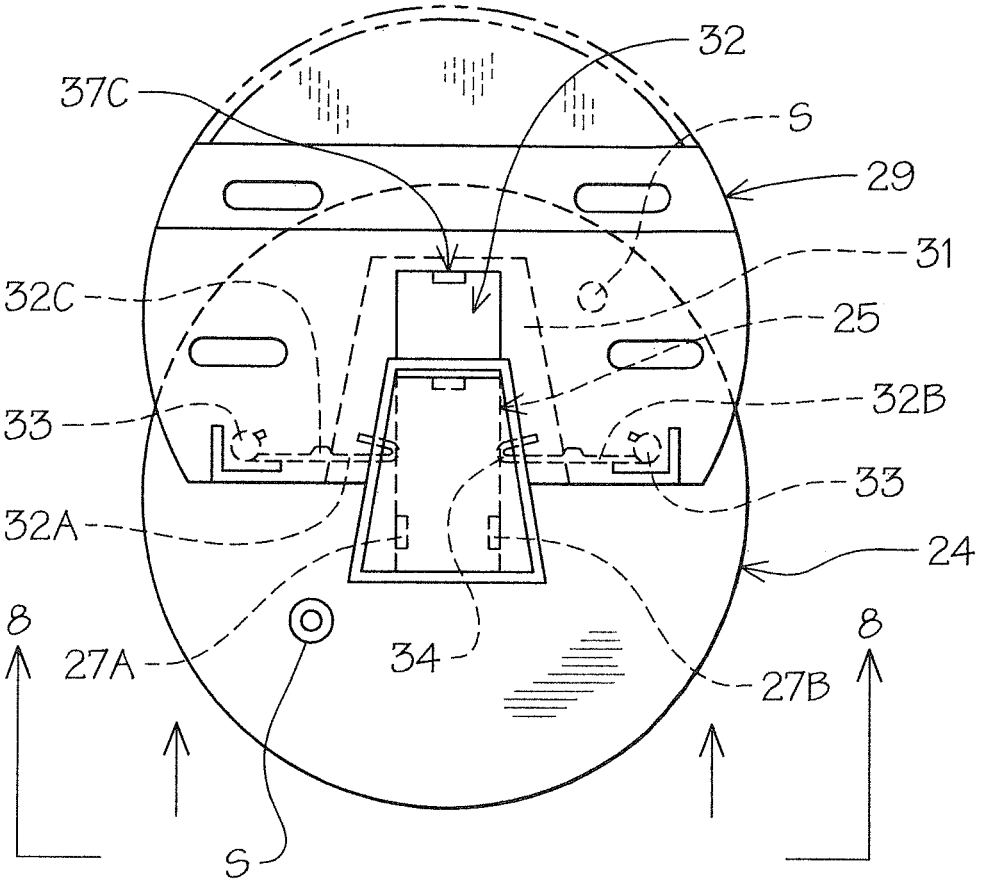
FIG. 7 is a front elevation composite view of the electrical fixture adaptor engaging the adaptor plate.

The power contact wires 32A and 32B extend from and are secured by power connector screws 33 respectively in each of the wires 32A and 32B have a return free end bent at 34 that extends marginally into the defined opening 32 for selective resilient engagement with the hereinbefore described power transfer strips 27A and 27B on the power transfer block 25 when slidably engaged therein as illustrated in FIG. 7 of the drawings. Each of the contact wires 32A and 32B have an area of reduced axial dimension at 32C to act as a fusable link that will provide circuit protection under high electrical load induced by a short, for example, as known in the art.

Figure 8:
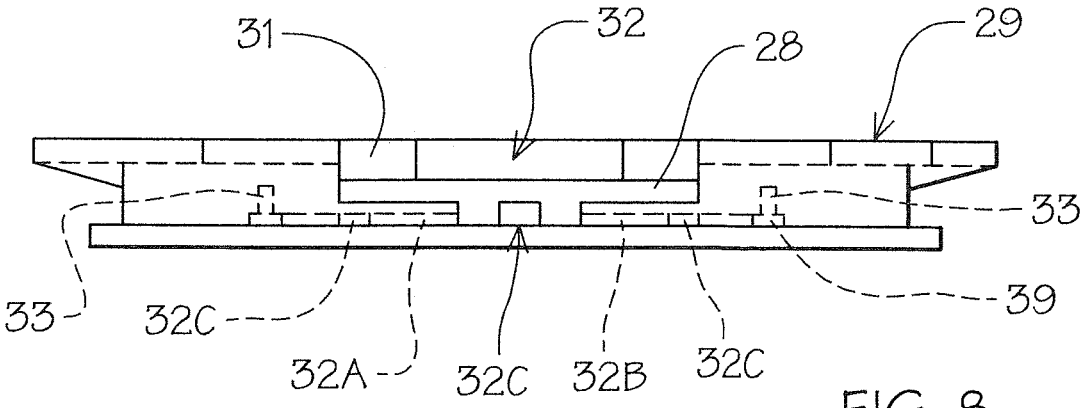
FIG. 8 is an enlarged bottom elevational view on lines 8-8 of FIG. 7.

It will be seen that the contoured recess 31 conforms to the tapered sides of the overlapping safety and engagement support cover 28 so as to provide an interlocking interface frictional fit there between as it progresses in engagement indicated by directional arrows in FIG. 7 and in broken lines in FIG. 8 of drawings. The opening 32 has a tapered base 35 to afford ease of alignment mount for receiving the power transfer block 25 on the electrical receptor adapter fitting 10. The interlocking fixture fitting will provide a one-step power connection and fixture support accordingly.

Figure 9:
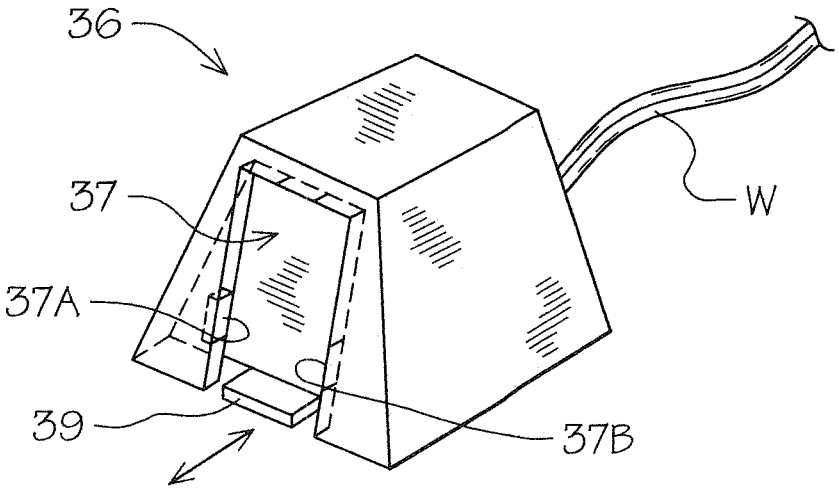
FIG. 9 is a perspective view of an electrical adapter plug of the system.
Figure 10:
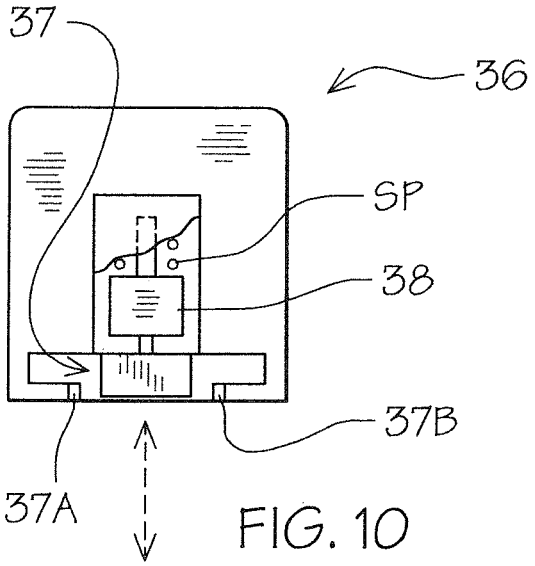
FIG. 10 is a bottom plan view thereof.
Figure 11:
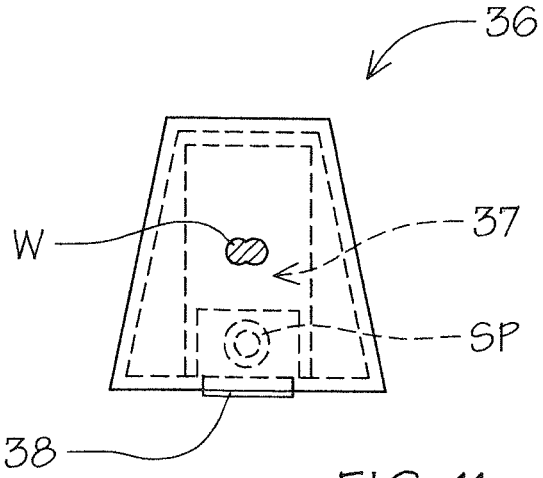
FIG. 11 is a partial front elevational view of an electrical adapter plug engaged on a receptacle with portions in broken and solid lines.

Referring to FIGS. 8, 9 and 10 of the drawings, a plug 36 of the invention can be seen having an electrical cord W end fitting with a female receiving opening 37 within and oppositely disposed electrical contact metal strips 37A and 37B.

A spring S urged retainment lock element button 38 is used to retract a resiliently advanced retainment element 39 on the bottom of the plug 36 so as to engage and hold the plug-in locked position once slidably engaged over the receptacle adapter fitting 10 as seen in FIGS. 1 and 3 of the drawings.

It will be seen that the plug 36 has the foreshortened triangular receiving opening slot at 37 into which the receptacle cover 28 is received allowing the power transfer block 25 to be slidably received therein and connect with the plug's contact metal strips 40A and 40B transferring power thereto and locking the plug-in place.

To remove the plug 36, the lock button 38 is user engaged releasing the plug 36 allowing it to slide up and off the receptacle, in this example.

Referring to FIGS. 6 and 7 of the drawings, a modified support fitting outdoor extension is illustrated of a hood element 39 shown in broken lines which will allow for use outdoors as so illustrated.

It will thus be seen that a new and novel electrical receptacle and fixture system has been illustrated and described that provides a simple one step fixture and support engagement and electrical connection through the use of a unique power transfer block and integrated safety cover support element unique and novel within the industry.

It will therefore be evident that various changes and modifications may be made thereto without departing from the spirit of the invention. Therefore,

We claim:

1. A power receptacle and fixture engagement system comprising in combination, a receptacle adapter fitting and a fixture mounting adapter plate, said adapter fitting having an upstanding power transfer block with oppositely disposed power contact strips and a ground connector thereon, a cover overlapping said power transfer block, said fixture mounting adapter plate having a female fitting with resilient power contact wires and a fixed ground contact connector there between.

2. The power receptacle and fixture engagement system set forth in claim 1 wherein said cover defines a pair of parallel spaced receiving retainment channels for said fixture mounting adapter plate.

3. The power receptacle and fixture engagement system set forth in claim 1 wherein said resilient power contact wires are selectively engaged by a respective conductive metal side surface strips of said receptacle adapter fitting upon full engagement of said mounting adapter plate and said receptacle adapter fitting to one another.

4. The power receptacle and fixture engagement system set forth in claim 1 wherein said resilient power contact wires in said female fitting have power connector screws in connection with a source of power.

5. The power receptacle and fixture engagement system set forth in claim 1 further comprises in combination a remote plug having a plug body, a pair of power wires extending from said body, a female receiving opening, power contact strips within said female receiving opening in communication with said power wires, a resilient retainment element for selective engagement with said receptacle adapter fitting upon engagement thereon.

* * * * *